US011453938B2

(12) United States Patent
Romfo et al.

(10) Patent No.: US 11,453,938 B2
(45) Date of Patent: Sep. 27, 2022

(54) METHOD FOR AND EQUIPMENT FOR SUPPRESSING DISCOLORATION OF AL—MG PRODUCTS

(71) Applicant: NORSK HYDRO ASA, Oslo (NO)

(72) Inventors: Alf Inge Romfo, Grøa (NO); Snorre Rist, Sunndalsøra (NO); Idar Kjetil Steen, Sunndalsøra (NO); Geir Øyen, Furugrenda (NO); Øystein Bauger, Trondheim (NO); Oddvin Reiso, Sunndalsøra (NO); Tanja Pettersen, Trondheim (NO)

(73) Assignee: NORSK HYDRO ASA, Oslo (NO)

( * ) Notice: Subject to any disclaimer, the term of this patent is extended or adjusted under 35 U.S.C. 154(b) by 241 days.

(21) Appl. No.: 16/731,136

(22) Filed: Dec. 31, 2019

(65) Prior Publication Data

US 2020/0232080 A1 Jul. 23, 2020

(30) Foreign Application Priority Data

Jan. 17, 2019 (NO) ..... 20190062

(51) Int. Cl.
*C22F 1/047* (2006.01)
*C22C 1/06* (2006.01)
*C22C 21/06* (2006.01)

(52) U.S. Cl.
CPC ..... *C22F 1/047* (2013.01); *C22C 21/06* (2013.01)

(58) Field of Classification Search
CPC .... C22F 1/047; C22F 1/02; C22F 1/05; C22C 21/06; C22C 21/08; C21D 9/0081; C21D 9/70; C21D 11/00; F27B 5/04; F27B 5/16; F27D 7/02; F27D 7/06; C23F 15/00
See application file for complete search history.

(56) References Cited

U.S. PATENT DOCUMENTS 2,092,033 A 9/1937 Stroup
2,885,313 A 5/1959 Milliken
6,881,491 B2 4/2005 Jankosky et al.
(Continued)

FOREIGN PATENT DOCUMENTS

WO 2008/103802 8/2008

OTHER PUBLICATIONS

Stevens et al., "Oxidation of rolled and flash anodized 3000 aluminum in air, nitrogen, oxygen, and carbon dioxide atmospheres", Materials Science Forum, vol. 693, pp. 63-70, 2011.
(Continued)

*Primary Examiner* — Anthony M Liang
*Assistant Examiner* — Danny N Kang
(74) *Attorney, Agent, or Firm* — Wenderoth, Lind & Ponack, L.L.P.

(57) ABSTRACT

Method and means for suppressing discoloration during thermal treatment of a product of a magnesium containing aluminium alloy, the alloy contains in wt. % Mg: 0.45-12.0, with a preferred range of 0.45-6.0 wt %. The product, being either an extrusion billet, a sheet ingot, a cast product, or a forged product is heated to a temperature T where it is prone to surface discoloration and oxidation, wherein during the thermal treatment it is exposed to a suppressing atmosphere comprising 0.5-5.0% $CO_2$ gas with a preference for 0.5-1.5% $CO_2$ gas.

10 Claims, 11 Drawing Sheets

(56) References Cited

U.S. PATENT DOCUMENTS

2004/0229071 A1* 11/2004 Jankosky ..... C22F 1/04
428/621
2009/0269239 A1* 10/2009 Nagakura ..... B22D 21/007
420/542

OTHER PUBLICATIONS

Cochran et al., "Oxidation of Aluminum-Magnesium Melts in Air, Oxygen, Flue Gas, and Carbon Dioxide", Metallurgical Transactions B, vol. 8B. Jun. 1977, pp. 323-332.

* cited by examiner

METHOD FOR AND EQUIPMENT FOR SUPPRESSING DISCOLORATION OF AL—MG PRODUCTS

The present invention relates to a method and an equipment for suppressing discoloration of Mg containing aluminium alloys during thermal treatment of products in solid state.

Magnesium is widely used as an alloy element in aluminium alloys for all kind of manufacturing processes, e.g. extrusion, rolling, forging and casting. For extrusion and rolling the molten metal alloys are commonly solidified as products represented by extrusion billets and sheet ingots, respectively. Regarding casting, the products are commonly produced by solidifying the molten metal alloy in casting molds. In case of forging, the input material is a cast material that in some cases are pre formed (by e.g. extrusion) in order to achieve at the desired pre shape.

One problem regarding products of magnesium containing aluminium alloys is that they are prone to obtaining a surface discoloration after some kind of thermal treatment. It is believed that this is due to an oxidizing reaction of the magnesium in the alloy that has migrated to the product surface with the oxygen in the surrounding air. It has been observed that such oxidizing influences the surface of the product and in particular the color thereof. Dark spots can appear on the surface of the product or the surface color can be dark in its entirety.

This may cause rejections or scrapping due to non-compliance with established quality standards and may also cause malfunctions in process equipment due to sensor detection failure. This is in particular valid for light, including laser, based sensor systems.

Surface oxidation or surface degeneration of solid state products of magnesium containing aluminium alloys represents a challenge and has been remedied in various manners in the prior art.

U.S. Pat. No. 2,092,033 discloses thermal treatment of aluminum and aluminum base alloys to obtain protection against attack such as blistering and permanent discoloration of the metal surface. The treatment involves heating a fluorine containing compound capable of yielding a vaporous fluorine-containing product and exposing the alloy to the fluorine-containing product.

U.S. Pat. No. 2,885,313 relates to thermal treatment of finished or semi-finished articles of aluminum-magnesium alloys to prevent subsequent atmospheric and high temperature oxidation and corrosion. The articles are coated with an organic ammonium fluoroborate which yields $BF_3$ when heated.

U.S. Pat. No. 6,881,491 B2 discloses cleaning of an aluminum alloy article to remove oxides and organic matter from a coatable surface, coated with a composition comprising an organic resin and a fluorine compound, and then heated to an elevated temperature to decompose the organic resin and at least a portion of the fluorine compound. After heating the coated surface is left with a protective oxyfluoride film that prevents blistering and hydrogen pickup and promotes hydrogen degassing from the article.

In the paper "Oxidation of rolled and flash anodized 3000 aluminium in air, nitrogen, oxygen and carbon oxide atmospheres", Darcy Stevens et. al., Materials Science Forum Vol. 693 (2011) pp 63-70, it is reported investigation of thermal oxidation of a flash anodized surface versus an untreated rolled surface of a 3000 Al sheet rolled alloy. Tests have been carried out in several atmospheres such as 100% $CO_2$, 50% $CO_2$-50% air, 10% $CO_2$-90% air and 100% air, where the flash anodized samples had lower mass gain for 10% $CO_2$-90% air, indicating that a low amount of $CO_2$ may reduce the rate of oxidation of this kind of article. This effect was not indicated for the non-anodized sample, i.e. the rolled 3000 aluminium sample.

In the prior art, several publications disclose that oxidation of Al—Mg alloys in a molten state can be suppressed in environments having mixtures of CO2 containing gases.

In the paper; C.N. Cochran et al. "Oxidation of Aluminum-Magnesium melts in Air, Oxygen, Flue Gas, and Carbon Dioxide", Metallurgical Transactions B, Volume 8B, June 1977-323, it is disclosed application of a protective gas above an aluminum melt containing more than 5% Mg, where the protective gas has a CO2 concentration above 20%.

WO2008/103802A1 discloses passing a carbon dioxide containing cover gas comprising at least about 5 volumetric percent up to 100 volumetric percent carbon dioxide over one or more surfaces of a molten aluminum-magnesium alloy, thereby forming a protective barrier on the surface of the molten aluminum-magnesium alloy.

By the present invention it is possible to omit or reduce the disadvantages regarding surface discoloration or oxidation of magnesium containing aluminium alloy products during thermal treatment by exposing said products to a defined gas composition that suppresses or eliminates oxidation. Further, the novel gas composition represents an environmental and less-hazardous alternative to available solutions.

These and further advantages can be achieved by the invention as defined by the accompanying patent claims.

The invention will be further described in the following by way of examples and with reference to the drawings and figures where:

FIG. 1 is a sketch showing an example of a layout of a batch homogenisation furnace, seen from one side, FIG. 2 is sketch showing an end view of the homogenisation furnace shown in FIG. 1, FIG. 3 is a sketch showing a top view of the homogenisation furnace of FIG. 1, FIG. 4 is a sketch showing an example of a layout of a continuous homogenisation furnace, seen from one side, FIG. 5 is a sketch showing a top view of the furnace shown in FIG. 4, FIG. 6 is a photo taken of two end cuts of one extrusion billet homogenized in normal atmosphere, FIG. 7 is a photo taken of two end cuts of one extrusion billet homogenized in an atmosphere containing ca. 1% $CO_2$, FIG. 8 is a photo taken of a sample exposed to 1% $CO_2$ and Air, FIG. 9 is a photo taken of a sample exposed to 2% $CO_2$ and Air, FIG. 10 is a photo taken of a sample exposed to 3% $CO_2$ and Air, FIG. 11 is a photo taken of a sample exposed to Air.

The present invention relates to suppressing discoloration or oxidation of solidified products of magnesium containing alloys where the alloy can contain magnesium in the range from 0.45% Mg up to 12% Mg, and more particular in the range 0.45-6% Mg.

The thermal treatment temperature T can be in the interval 450-610 degrees Celsius.

Further, according to the invention, the surface of the product is exposed to an atmosphere that contains 0.5-5% $CO_2$, and more particular in the range 0.5-1.5% and as preferred concentration of approximately 1%.

The mechanism that makes the protective layer by means of $CO_2$ gas concentrations as described here is the same for all alloys having a Mg content as described here. This mechanism restricts diffused Mg from getting in contact with oxygen in the atmosphere, and therefore it hinders the formation of Mg-oxide and consequently that the surface becomes dark. Due to this mechanism it is not the Mg content as such that is decisive, but that the protective layer itself is formed.

In FIG. 1 there is shown a sketch of a layout of a batch homogenisation furnace 10, seen from one side. A batch of billets 1 is arranged in the furnace. Further, the furnace has an electrical cabinet 2, a control cabinet for supply of $CO_2$ 3 and a $CO_2$ tank 4.

FIG. 2 is sketch showing an end view of the homogenisation furnace 10 shown in FIG. 1, with the batch of billets 1, inlet 6 for $CO_2$ and a measurement arrangement 5 for $CO_2$ gas concentration.

FIG. 3 is a sketch showing a top view of the homogenisation furnace 10 of FIG. 1, disclosing a batch of billets 1, inlets 6 for $CO_2$ gas, measurement arrangements 5 for $CO_2$ gas concentration. Further, there is disclosed the electrical cabinet 2, the control cabinet for supply of $CO_2$ 3 and the $CO_2$ tank 4.

In FIG. 4 it is disclosed an example of a layout of a continuous homogenisation furnace 11, seen from one side, there is disclosed an electrical cabinet 2', a control cabinet for supply of $CO_2$ 3', a $CO_2$ tank 4', an inlet 6' for $CO_2$ gas and a measurement arrangement 5' for $CO_2$ gas concentration. Floor level is indicated at FL and a log inlet at LI and log outlet at LO. The furnace has a Heating Compartment HE and a Holding Compartment HO.

In FIG. 5 it is disclosed a top view of the furnace shown in FIG. 4, where there is disclosed the electrical cabinet 2', the control cabinet for supply of $CO_2$ 3', $CO_2$ tank 4', inlet 6' for $CO_2$ gas and measurement arrangement 5' for $CO_2$ gas concentration. The log inlet is shown at LI and log outlet at LO. It is also disclosed the Heating Compartment HE and Holding Compartment HO.

EXAMPLE 1

After casting of an extrusion billet or a sheet ingot of a magnesium containing aluminium alloy, the product is often subjected to a homogenization heat treatment in a homogenization oven. A common homogenization practice is to heat the alloy to a temperature in the range 560-590° C. and keep it at that temperature between 1-5 hours.

During this treatment, $CO_2$ gas can be injected into the homogenization oven in a manner that practically the whole surface of each individual product is exposed to a sufficient concentration of the suppressing atmosphere.

The concentration of the suppressing atmosphere is controlled by one or more sensors connected to a controller such as a PLC that controls the outlet of a $CO_2$ source in relation to the measured value(s) and the set gas concentration. The source can be constituted by pressurized $CO_2$ containers or tanks.

The concentration of $CO_2$ can be adjusted to a level from 0.5% $CO_2$ up to 5% $CO_2$, where the rest is mainly natural air, at least for an electrically heated oven.

For a gas fired oven, the suppressing atmosphere can be adjusted slightly to compensate for the particular composition of the gas therein, due to the exhaust gases from the combustion.

For an induction oven, the procedure may be that the product is heated very rapidly followed by a suppressing $CO_2$ containing gas is brought to flow onto the surface of the product.

The $CO_2$ concentration needed to suppress discoloration can also be obtained by for instance, placing charcoal or other carbon containing combustable material in the heat treatment furnace Practical Ways of Implementing the Method in a Casthouse Extrusion billets of the Al—Mg—Si type are normally homogenised in the casthouse before transportation to the extrusion plant. There are two common types of homogenisation furnaces; batch homogenisation furnaces and continuous homogenisation furnaces.

Batch Homogenisation Furnace

In batch type of homogenisation furnaces the common procedure for homogenization is to insert a load of billets into a furnace chamber, then heat the billets to the desired homogenisation temperature and keep the billets at this temperature in the furnace chamber for a desired length of time. After the holding time, the furnace billet load is removed from the furnace chamber and cooled. Cooling is usually done in a cooling chamber or in a cooling station where the furnace load is cooled rapidly in forced air.

Casthouses may have several furnace chambers and cooling chambers. Since the heating and holding segment in the furnace chamber takes longer time than cooling in the cooling chamber the number of furnace chambers normally is larger than the number of cooling chambers.

Continuous Homogenisation Furnace

A continuous homogenisation furnace is normally divided in two or three parts, a heating zone, a holding zone and possibly a cooling zone. The individual logs of extrusion billets are moved through the zones of the furnace. A normal layout for a furnace divided two parts is a first heating chamber and next to that a holding chamber as in FIGS. 4 and 5.

One other common layout is to have the heating zone and the holding zone in the same chamber, with ample heating capacity in the heating zone and sufficient heaters to keep the metal temperature at the desired temperature in the holding zone.

The cooling zone is normally in a separate chamber or area, the logs are transferred from the holding zone to the cooling zone when they have reached the end of the holding zone. After suppressed air cooling, some casthouses also utilizes a water curtain cooling to reach a final temperature below 60° C. before sawing.

Practical Test

Two loads of billets were homogenized in the continuous homogenization furnace as shown in FIGS. 4 and 5, where the first load was homogenized without modifying the atmosphere, i.e. in air. The second load was homogenized in an atmosphere containing ca. 1% A $CO_2$ and the rest air. The two loads came from the same casting batch, i.e. it was the same metal alloy composition in both loads.

The aluminium alloy of the billets was AA6063 containing Mg 0.7222 wt %, Si 0.5219 wt % and Fe 0.2015 wt %.

The furnace was initially boosted to a $CO_2$ concentration that in short periods was approximately 2% to ensure good distribution of the gas. Following this, the concentration was adjusted in a controlled manner down to approximately 1%. Total cycle time for each billet was 4 h 10 min, where 1 h 54 min was in a heating zone and 2 h 15 min in a holding zone.

FIG. 6 is a photo taken of two end cuts of one extrusion billet homogenized in normal atmosphere, the end cuts are stacked one onto the other.

It can clearly be seen that the surface of the billet is discoloured with major parts being black.

FIG. 7 is a photo taken of two end cuts of one extrusion billet homogenized in an atmosphere containing ca. 1% $CO_2$ and rest air. The end cuts are stacked one onto the other.

The photo shows that the billet surface is light grey with no major discoloured areas.

Small Scale Experiments

To investigate the effect of various gases, and in particular the effect of CO2 concentrations on the surface appearance of as-cast billets, small scale ampoule experiments have been carried out. An AA6063 alloy was industrially cast, slices were cut from the ingot, and samples including the as-cast surface were machined from the ingot slice. A sample was placed in a quartz ampoule and the ampoule was filled with a selected gas and sealed.

The gases used in the experiments included (1) air; (2) 1% CO2 and 99% air; (3) 2% CO2 and 98% air; (4) 3% CO2 and 97% air; (5) 4% CO2 and 96% air; (6) 5% CO2 and 95% air; (7) 50% CO2 and 50% air; (8) 100% CO2; (9) 100% Ar; (10) 100% N2; (11) 100% O2; (12) 100% CO; (13) 50% CO and 50% Ar; (14) 25% CO and 75% Ar; (15) 1% CO and 99% Ar.

The ampoule samples were heated at a rate of 200° C./h to 575° C. and/or 580° C., held at this temperature for 2.5 hours and subsequently air-cooled. In Table 1 there is given some visual assessments for the samples.

TABLE 1

| | Surface colour |
|---|---|
| Air | Partly black |
| 1% CO2 and 99% air | Not black |
| 2% CO2 and 98% air | Not black |
| 3% CO2 and 97% air | Partly black |
| 4% CO2 and 96% air | Partly black |
| 5% CO2 and 95% air | Partly black |
| 50% CO2 and 50% air | Partly black |
| 100% CO2 | Black |
| 100% CO | Black |
| 50% CO and 50% Ar | Black |
| 25% CO and 75% Ar | Black |
| 1% CO and 99% Ar | Black |

Figure 1:
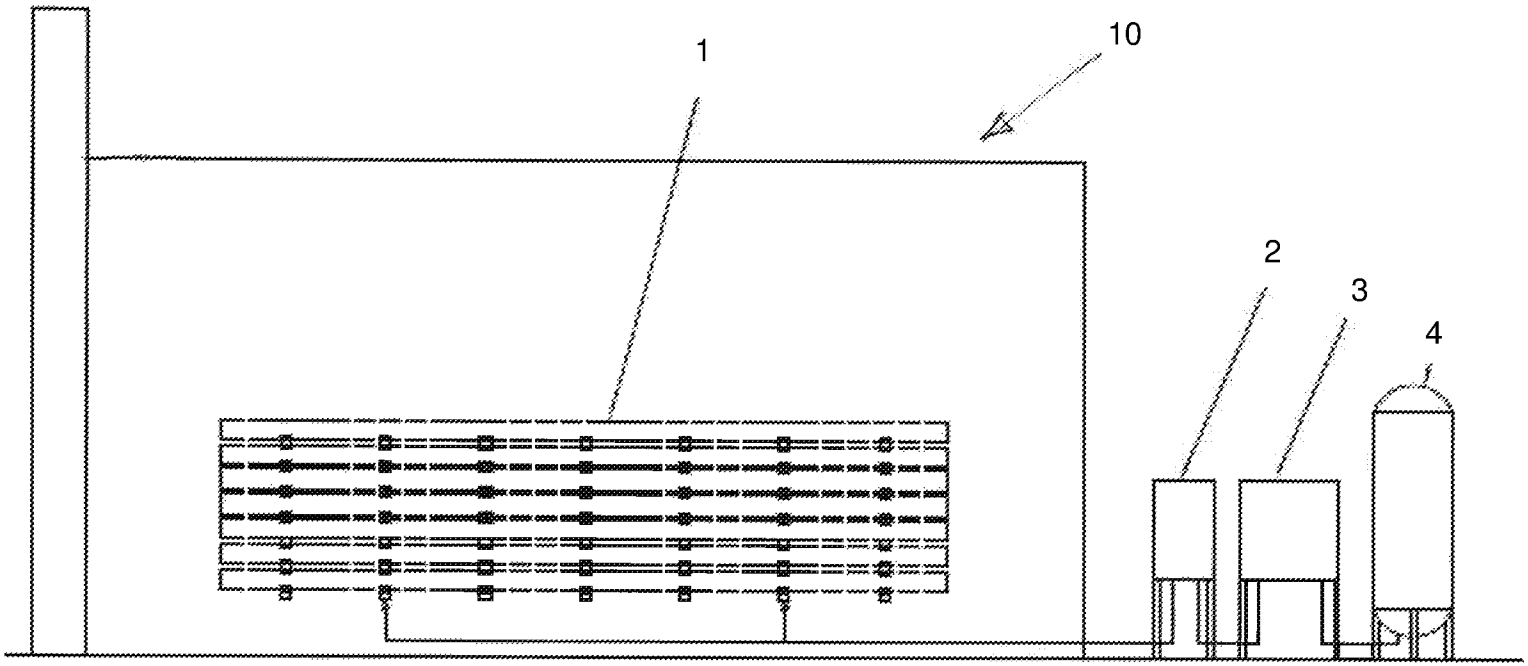
Figure 2:
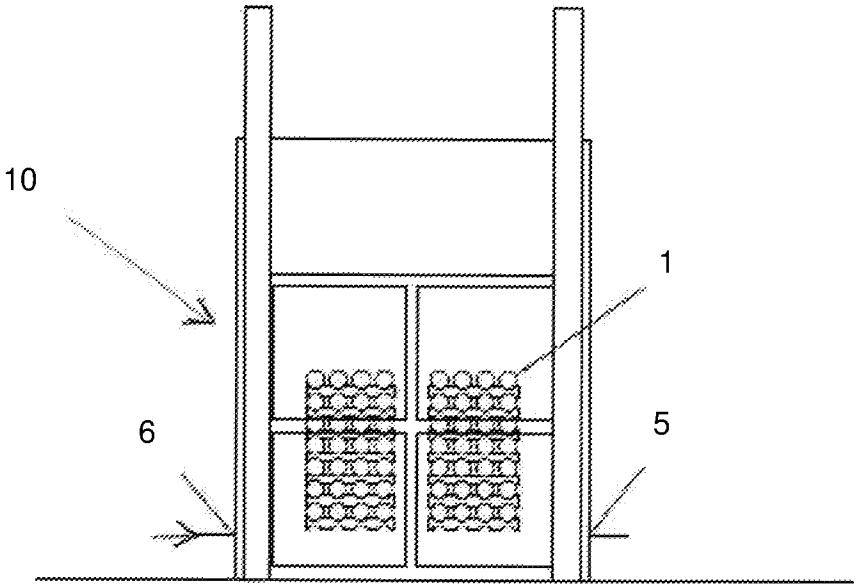
Figure 3:
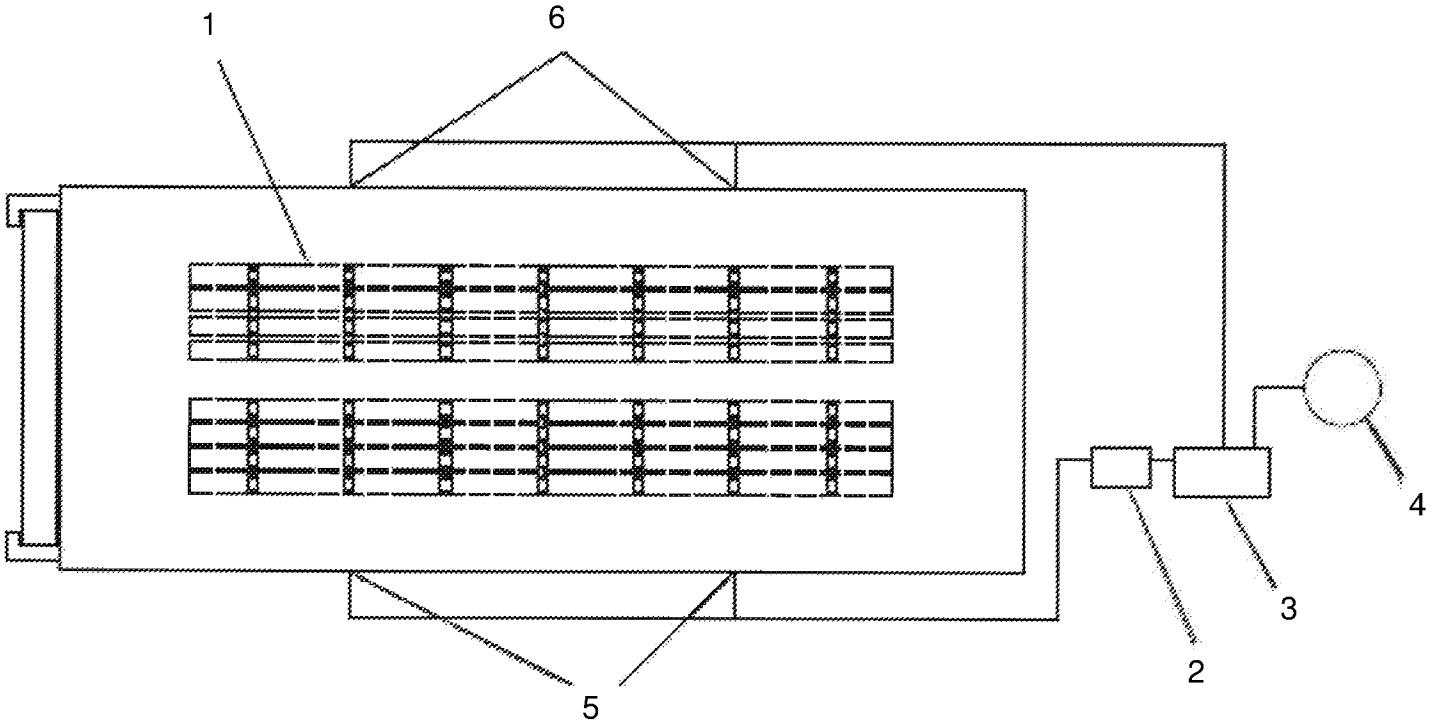
Figure 4:
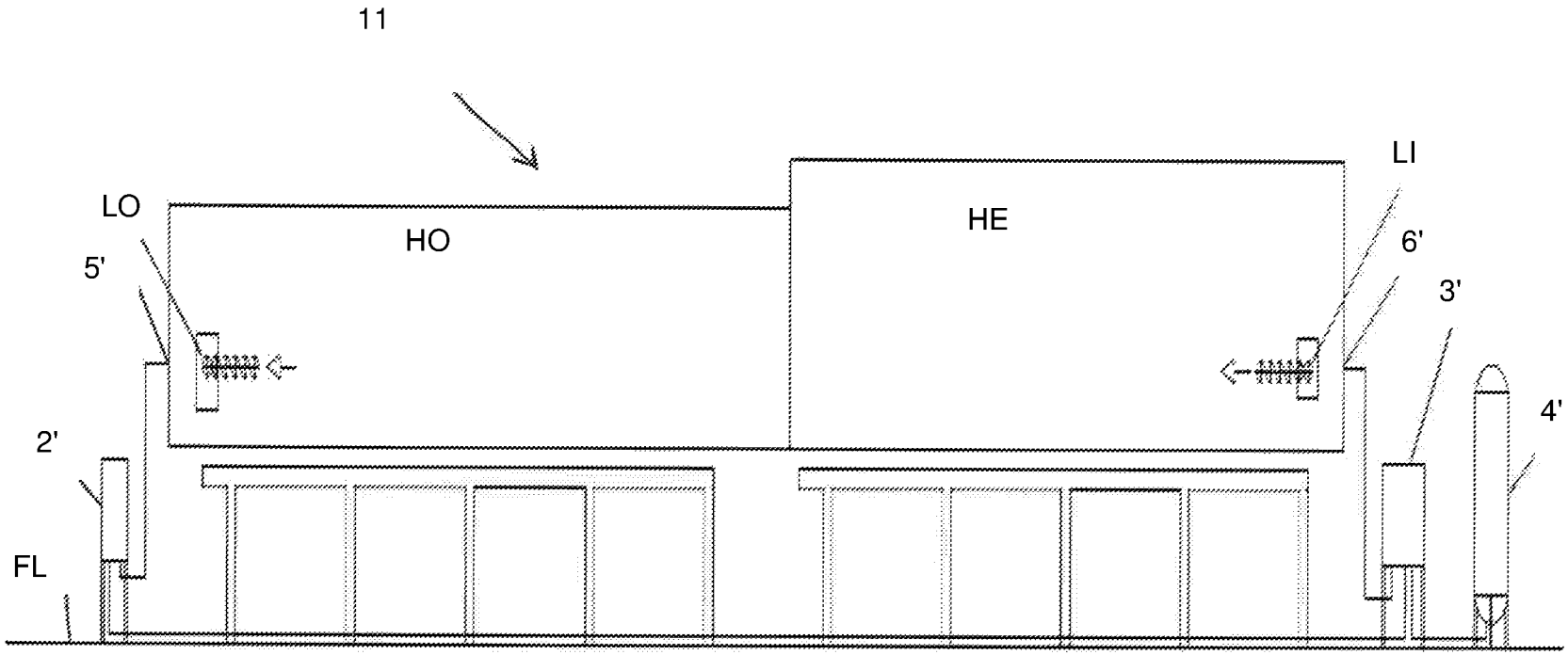
Figure 5:
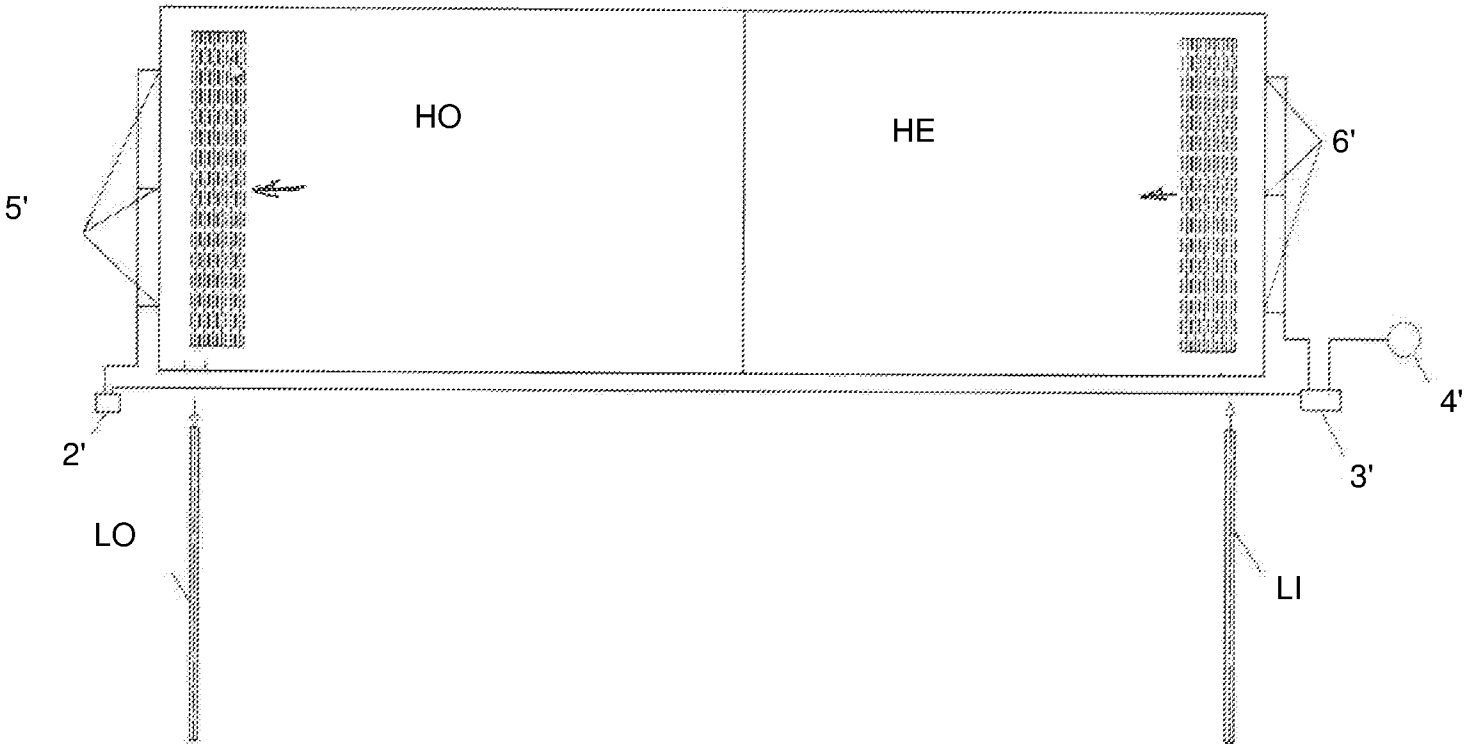
Figure 6:
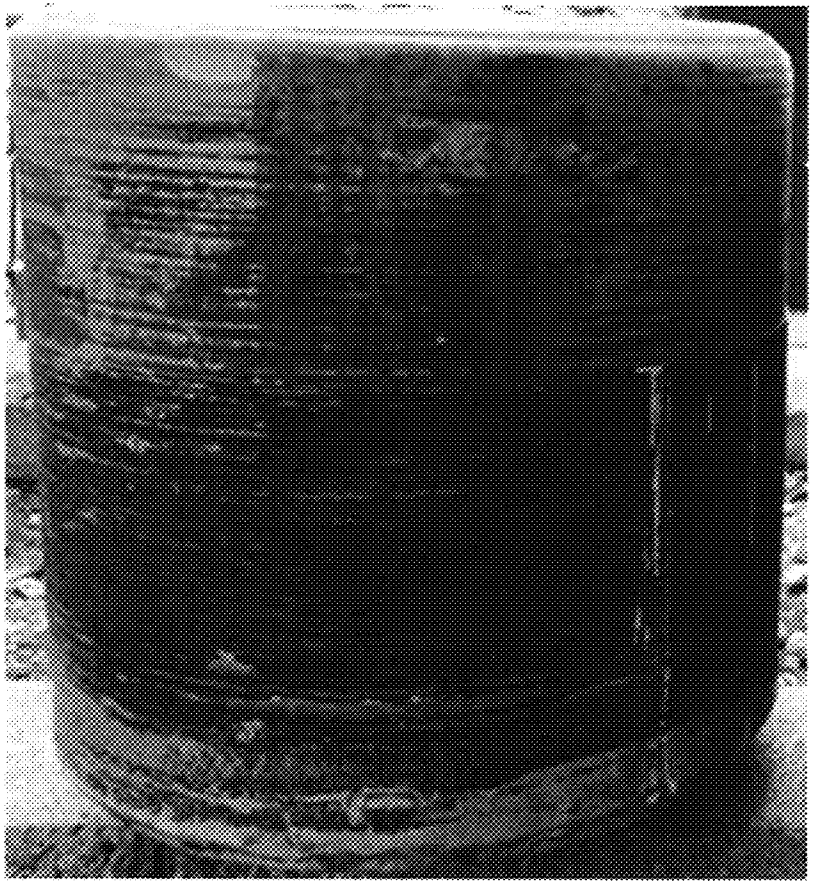
Figure 7:
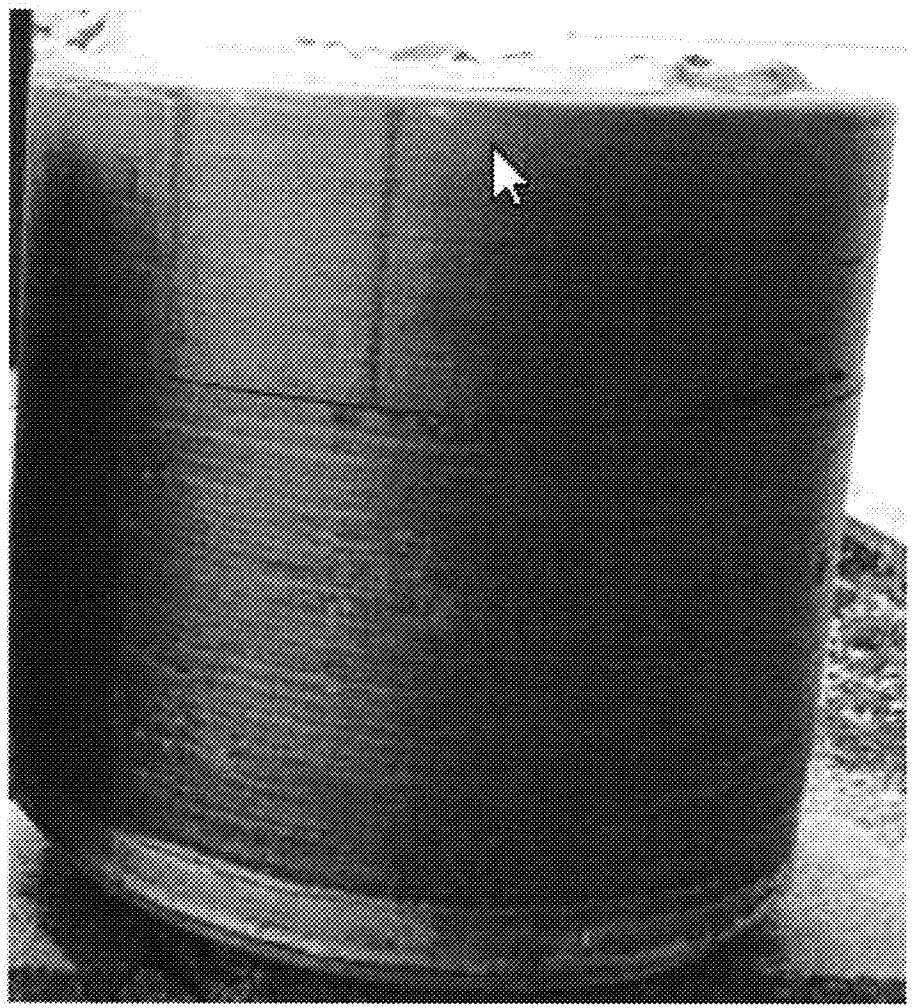
Figure 8:
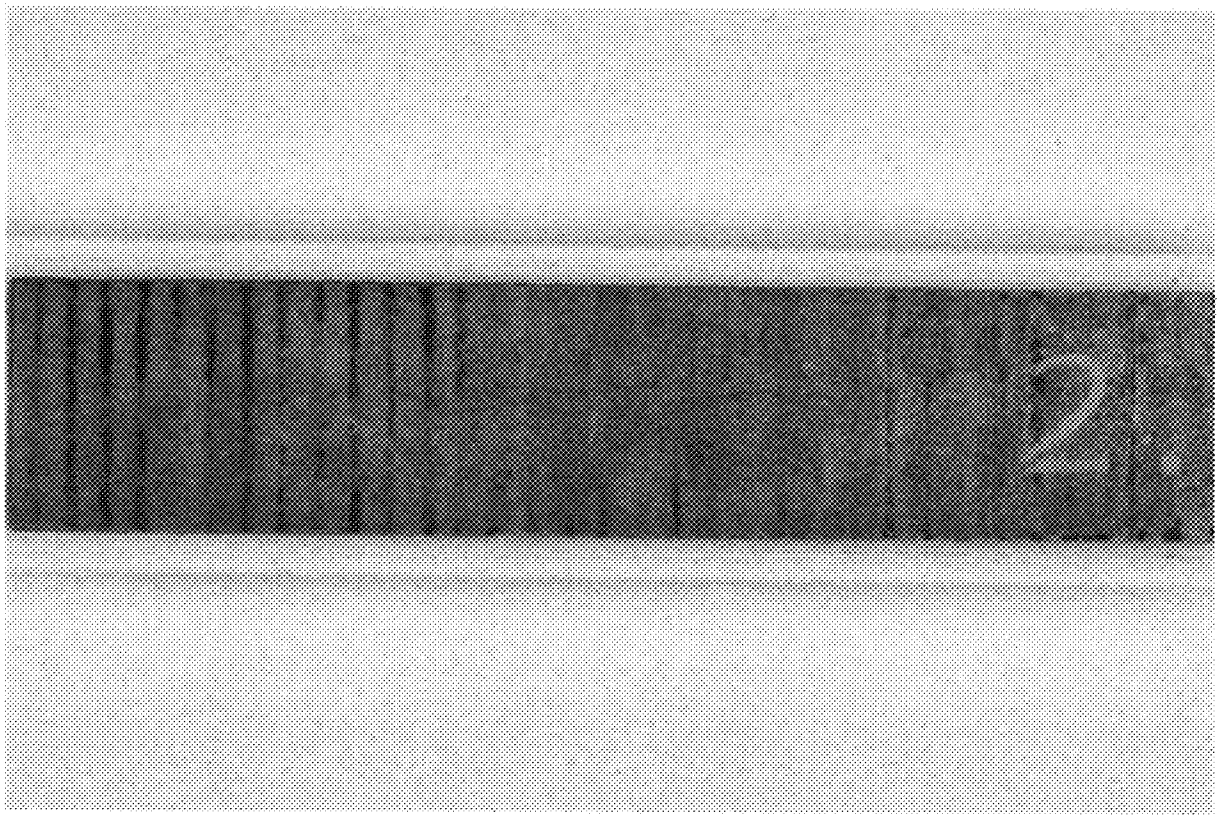
FIG. 8 shows a photo of a sample exposed to 1% $CO_2$ and Air. The sample is not black.
Figure 9:
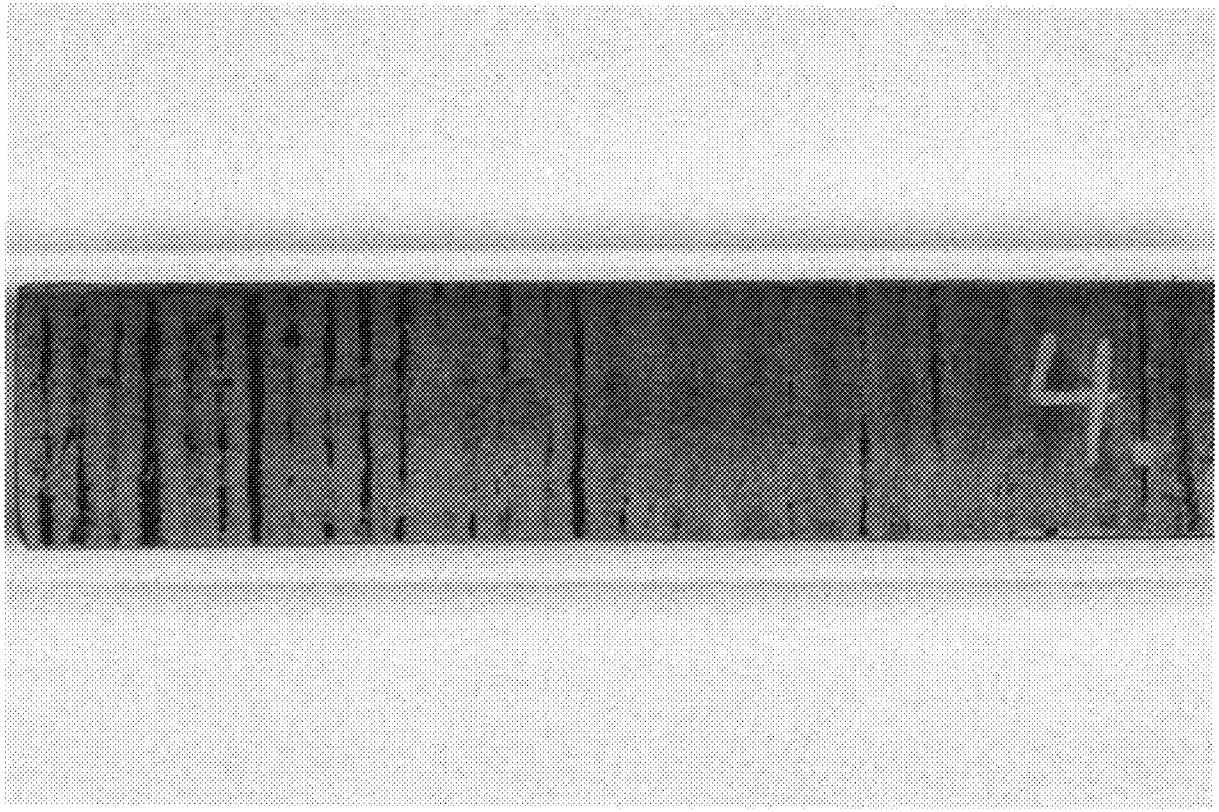
FIG. 9 shows a photo of a sample exposed to 2% $CO_2$ and Air. The sample is not black.
Figure 10:
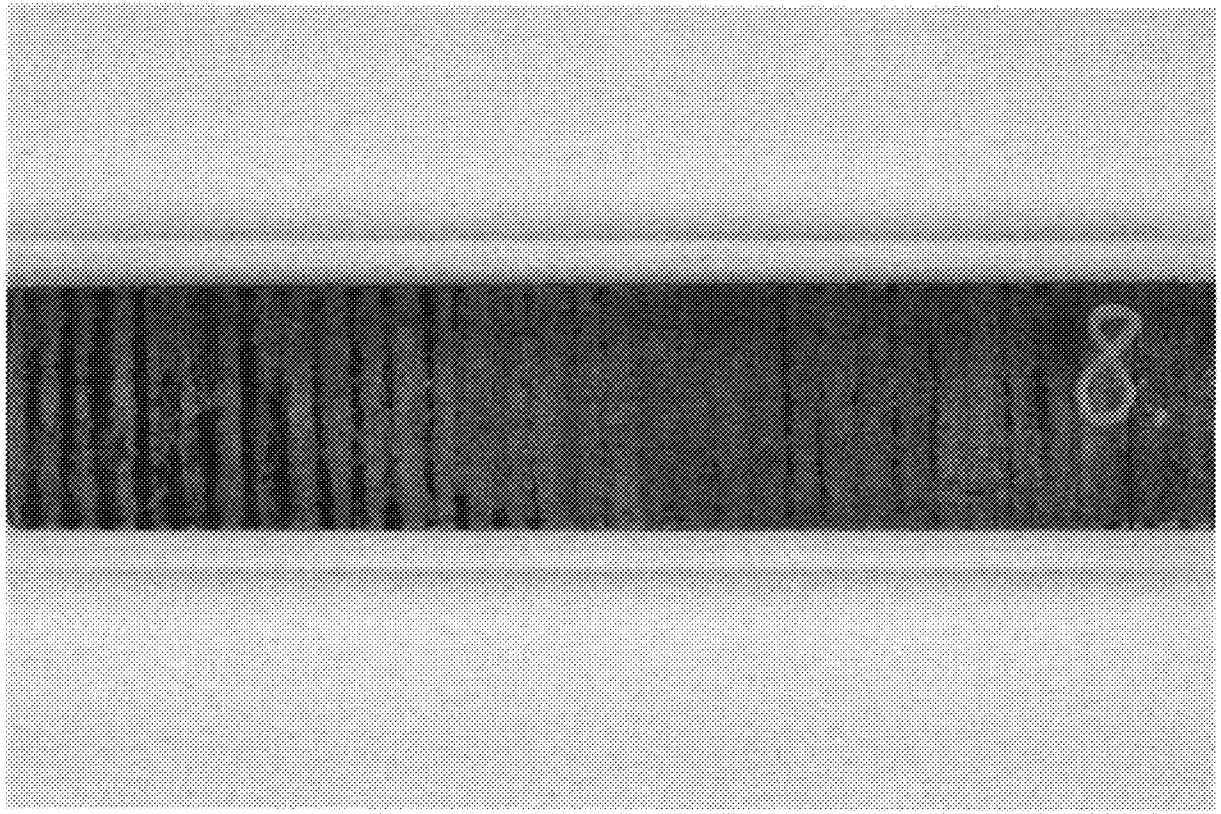
FIG. 10 is a photo of a sample exposed to 3% $CO_2$ and Air. The sample is partly black.
Figure 11:
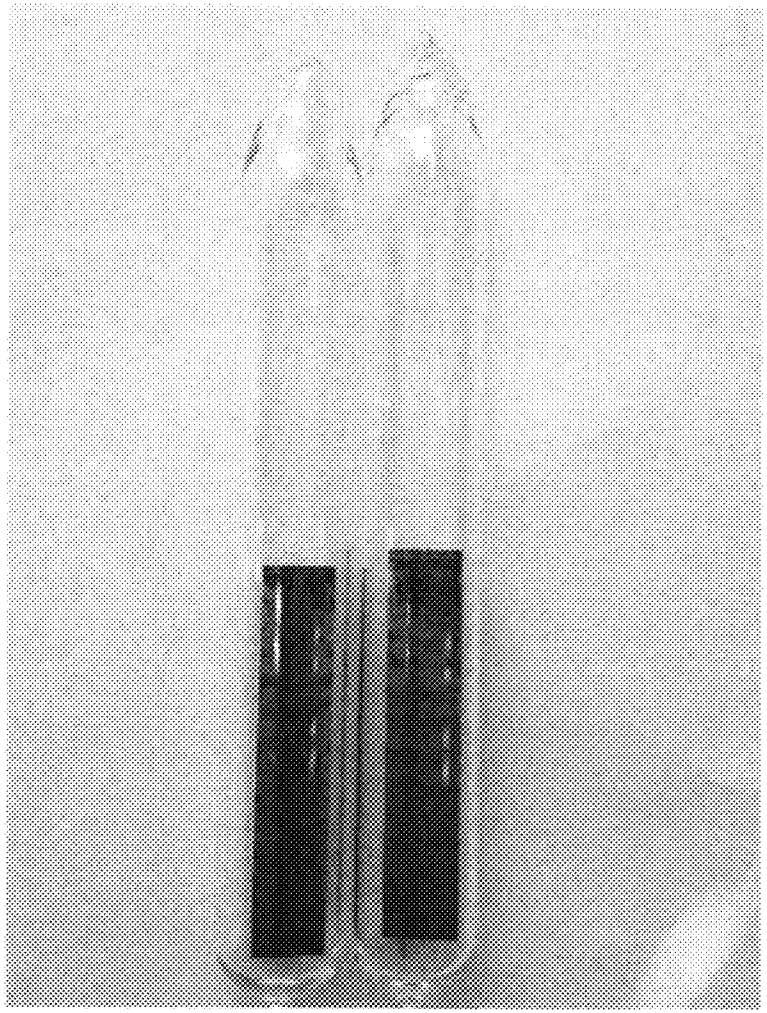
FIG. 11 is a photo taken of a sample exposed to Air. The sample is partly black.

The invention claimed is:

1. A method for suppressing discoloration during thermal treatment of a product of a magnesium containing aluminium alloy, the alloy containing in wt. %

Mg: 0.45-12.0 where the product, being either an extrusion billet, a sheet ingot or a cast product, is heated to a temperature T where the product is prone to surface oxidation, wherein the product during the thermal treatment is exposed to a suppressing atmosphere comprising 0.5-5.0% $CO_2$ gas.

2. The method according to claim 1, wherein the rest of the suppressing atmosphere comprises natural air.

3. The method according to claim 1, wherein the rest of the suppressing atmosphere comprises a mix of natural air and exhaust gases from combustion of natural gas or other gas compositions.

4. The method according to claim 1, wherein the suppressing atmosphere comprises 0.5-1.5% $CO_2$ gas.

5. The method according to claim 1, wherein the suppressing atmosphere comprises approximately 1.0% $CO_2$ gas.

6. The method according to claim 1, wherein the suppressing atmosphere comprises 1.0% $CO_2$ gas and 99% air.

7. The method according to claim 1, wherein the alloy contains 0.45-6 wt % Mg.

8. The method according to claim 1, wherein the method further comprises exposing the cast product to various degrees of forming or machining between casting and the thermal treatment.

9. The method according to claim 1, wherein the temperature T is between 450° C. and the melting point of the alloy.

10. The method according to claim 1, wherein a holding time of up to 15 hours at the temperature T is applied.

* * * * *